US008225562B2

(12) United States Patent
Parker

(10) Patent No.: US 8,225,562 B2
(45) Date of Patent: Jul. 24, 2012

(54) DIVIDED LIGHT WINDOWS HAVING MAGNETICALLY-ATTACHED GRIDS

(76) Inventor: Robert Floyd Parker, Lindon, UT (US)

( * ) Notice: Subject to any disclaimer, the term of this patent is extended or adjusted under 35 U.S.C. 154(b) by 208 days.

(21) Appl. No.: 12/661,673

(22) Filed: Mar. 19, 2010

(65) Prior Publication Data

US 2010/0236167 A1 Sep. 23, 2010

Related U.S. Application Data

(60) Provisional application No. 61/161,727, filed on Mar. 19, 2009.

(51) Int. Cl.
*E04C 2/38* (2006.01)

(52) U.S. Cl. ..... 52/204.61; 52/311.2; 52/204.595; 52/204.62

(58) Field of Classification Search ..... 52/311.1, 52/311.2, 312–316, 455–458, 204.59, 204.591, 52/204.592, 204.6, 204.61, 204.62, 204.63, 52/204.64, 204.67, 204.68, 204.69
See application file for complete search history.

(56) References Cited

U.S. PATENT DOCUMENTS

| | | | | |
|---|---|---|---|---|
| 4,783,938 | A * | 11/1988 | Palmer | 52/171.3 |
| 5,077,950 | A * | 1/1992 | Bretches et al. | 52/456 |
| 5,826,638 | A * | 10/1998 | Jelic | 160/107 |
| 6,429,961 | B1 * | 8/2002 | Harary et al. | 359/296 |
| 2005/0210780 | A1 * | 9/2005 | Lyness et al. | 52/204.5 |
| 2008/0309099 | A1 * | 12/2008 | Torben | 292/251.5 |

* cited by examiner

*Primary Examiner* — Basil Katcheves
*Assistant Examiner* — Beth Stephan
(74) *Attorney, Agent, or Firm* — Angus C. Fox, III

(57) ABSTRACT

An improved simulated authentic divided-light windows, includes an internal muntin grid structure sandwiched between the panes of a double-glazed sealed window pane, and an external muntin grid removably attached to each side of the sealed window pane. The internal grid is equipped with multiple neodymium magnets, which are embedded in the grid structure at regular intervals, while the back side of each of the outer muntin grid structures is equipped with multiple steel or iron inserts which align with the neodymium magnets when the outer grids are positioned, as intended, on the sash. Outer grids used on the inside of a building can be made of wood or plastic. Outer grids used on the exterior of building are preferably made of extruded aluminum or other weather resistant material. The steel or iron inserts are threadably secured or adhesively bonded to apertures in the back side of the grid.

2 Claims, 5 Drawing Sheets

DIVIDED LIGHT WINDOWS HAVING MAGNETICALLY-ATTACHED GRIDS

This application has a priority date based on the filing of Provisional Patent Application No. 61/161,727, which was filed on Mar. 19, 2009.

FIELD OF THE INVENTION

This invention relates, generally, to faux multi-pane windows having grids, which make a large, single-pane window seem as though it is comprised of multiple, individually-glazed panes separated by muntins.

BACKGROUND OF THE INVENTION

A muntin is a strip of wood or metal separating and holding panes of glass in a window. Muntins can be found in doors and windows of certain styles of western architecture. The combination of muntins and glass creates a grid system dividing a single sash or casement into smaller panes, called "lights" or "lites". Until the middle of the 19th century, large panes of glass were so expensive to manufacture that it was economically advantageous to combine multiple smaller panes of glass in a grid for the manufacture of windows and doors having large light-transmissive expanses.

So-called true divided-light residential windows typically make use of thin muntins which range from ½-inch to ⅞-inch in width. In windows constructed with wood framing, a fillet is cut into the outer edge of the muntins so as to provide a seat for a pane of glass within each opening of the grid. Putty or thin strips of wood or metal are then used to hold each pane in place. The inner sides of wooden muntins are typically milled to traditional profiles. In the U.S., the thickness of window muntins has varied historically, ranging from very slim muntins for use in 19th-century Greek revival buildings to thick muntins for use in 17th- and early-18th-century buildings.

In spite of the fact that the muntins of divided-light windows interfer with the view, many consider such windows to be more architecturally attractive than those of the single-pane variety. In addition, divided-light windows are inextricably connected with particular styles of architecture, and any attempt to build in these styles using single-pane windows is likely to be viewed not only as an exercise in poor taste, but as a cheap substitute for the genuine article. It would be unimaginable, for example, that anyone having even a modicum of architectural sensibility would attempt to build a colonial style structure using single-light windows. In addition, restoration of period-built structures requires adherence to architectural rules of that period.

The problem of maintaining architectural authenticity was compounded by the oil energy crisis of the 1970's that resulted from an oil embargo initiated by certain petroleum producing countries in 1973 in response to U.S. support for Israel during the Yom Kippur War. Single-pane windows suddenly became obsolete because their insulative R value was a mere 0.9. For structures having large expanses of single-pane windows—and this characteristic typically applied to colonial style buildings—this abysmal R-value rating guaranteed unacceptable levels of heat transfer from the interior to the exterior during winter months and in the opposite direction during summer months. Although single-pane windows are well-adapted to traditional muntins, double-pane windows are more than twice as heavy because a thick gasket, positioned around the edges of the assembly, not only maintains the separation of the double panes, but also seals the dead space between them. A true divided-light, double-pane window would therefore require the use of much heavier and considerably more expensive muntins. In comparison to the muntins of a divided-light window made of single panes, such muntins would, indeed, appear ungainly.

In an effort to avoid the high cost and unattractive appearance of true divided-light double-pane windows, window manufacturers began to supply double-pane windows having bar grills positioned between the spaced-apart double panes. Alternatively, they produced removable contoured grills which, generally, were attachable to the interior side of the double-pane glazing. Under certain, unexceptional lighting conditions, fake muntins of both types can be detected from great distances by casual observers. In fact, fake muntins have come to be regarded as a halmark of tawdry construction.

The only reasonable alternative to prohibitively-expensive and ungainly true divided-light double- and triple-pane windows, on one hand, and fake muntin grills on a large, single-light window, on the other, is a window structure accurately described as a simulated-authentic, divided-light window. The structure consists of a double- or triple-glazed sash having an authentically-detailed muntin assembly adhered to each side thereof. Muntin assemblies exposed to the elements are generally made of aluminum extrusions or other non-weathering elements. A final and essential element of the simulated-authentic window structure is the inclusion of a spacer grid between each adjacent pair of glass panes. The spacer grid not only strengthens the multi-pane sash, but also makes it appear—even on close inspection—that both muntin assemblies and the spacer grid(s) are unitary and physically separate the individual lights. Any multi-light window having any less a structure appears cheap and fake.

A major drawback associated with true, divided-light windows of both single- and multi-pane varieties is the intensive manual labor required both to clean the panes of the individual lights several times each year, as well as to paint the muntins every five to ten years. Simulated divided-light windows suffer from the same drawback if the muntin assemblies are permanently adhered to the outer surfaces of the sash. It has been estimated that the time required to clean both sides of a divided-light window can be as much as ten times that required to clean a single-light windows of the same size. The spray painting of removable muntin grids is a simple task, whereas the painting of a muntin grid without removal requires extensive masking and/or careful painting with a small brush. Thus, simulated-authentic, divided-light windows having removable outer muntin assemblies have a tremendous advantage over windows which are not temporarily convertible to single-light windows, both from the standpoint of manufacturing cost and the cost of ongoing maintenance. Nevertheless, removable muntin assemblies must be reliably secured to the sash. Muntin assemblies attached to the exterior surface of a sash must withstand exposure to the wind and the elements. If a mechanical muntin securing mechanism is employed, it must not degrade significantly over time. If one were to fall off the sash, it could not only pose a danger to a nearby object or person, but could also be damaged by impact with the ground.

A number of methods for constructing simulated divided-light windows have been devised over the years which have transpired since the Yom Kippur War. U.S. Pat. No. 4,783,938 to Douglas J. Palmer, for example, discloses a simulated divided-light window structure that is compatible with insulated double-glazed windows. The structure makes use of an internal grid structure and two external grid structures to achieve a realistic divided-light appearance. This structure does nothing to reduce the labor required to clean such windows, as both external grid structures are adhesively bonded to the glass panes. U.S. Pat. No. 5,077,950 to Donald D. Bretches, et al., on the other hand, discloses a simulated divided-light window structure for single-glazed windows, in which a pair of simulated muntin grids are attached to opposite sides of a pane through mutual magnetic attraction. There are several problems associated with this structure. The first is that the method is inapplicable to simulated muntin grids fabricated from hollow extruded aluminum members, as the method requires a magnetic or ferromagnetic strip to be adhesively bonded within groove formed on the back side of each muntin member. The method is also subject to adhesive bonding failure over time. Furthermore, the method will not work with double pane windows, as insufficient magnetic force is generated by a permanent magnet to bridge the gap between the panes.

What is needed is an improved structure for authentically simulating true divided-light windows. As with the U.S. Pat. No. 4,783,938, the structure must employ an internal grid structure in combination with a pair of external grid structures in order to achieve authentic simulation. However, the external grids structures must not only be secured by means which will not degrade over time, but they must be readily and quickly removable to facilitate window cleaning operations.

SUMMARY OF THE INVENTION

The present invention fulfills the heretofore expressed need for aforementioned need for an improved structure which authentically simulates true divided-light windows. The improved structure employs an internal muntin grid structure in combination with a pair of external muntin grid structures in order to achieve authentic simulation. The internal muntin grid is equipped with multiple neodymium magnets, which are embedded in the grid structure at regular intervals. A neodymium, or NIB, magnet is a variety of rare-earth permanent magnet made of an alloy of neodymium, iron, and boron —$Nd_2Fe_{14}B$. They are the strongest type of permanent magnets currently available. The back side of each of the outer muntin grid structures is equipped with multiple steel or iron inserts which align with the neodymium magnets when the outer grids are properly positioned on the sash. Outer grids used on the inside of a building can be made of wood or plastic. The steel or iron inserts can be threaded, bonded, or both threaded and bonded in apertures formed in the wood. Outer grids used on the exterior of building are preferably made of extruded aluminum. The steel or iron inserts, which are preferably externally threaded, are anchored in internally-threaded apertures formed in the back side of the grid. The magnetic attachment means, which does not degrade over time, permits the outer grids to be easily and readily removed for cleaning of each side of the entire sash in a single operation.

Neodymium rare earth permanent magnets are a key component of the present invention. Permanent magnets have a fascinating history. Magnetite (also known as lodestone) is an iron ore that possesses natural permanent magnetism. About 1940, permanent magnets that were fifteen to seventeen times stronger than magnetite were first manufactured from an aluminum-nickel-cobalt (AlNiCo) alloy. In the 1970's, researchers developed permanent magnets formed from powdered samarium cobalt fused under heat. These magnets proved to be fifty time stronger than magnetite. In 1983, neodymium-iron-boron magnets were simultaneously developed in both Japan and the U.S. These magnets are about 75 times stronger than magnetite. They are so strong, in fact, that they can lift four hundred times their own weight!

PREFERRED EMBODIMENT OF THE INVENTION

Figure 1:
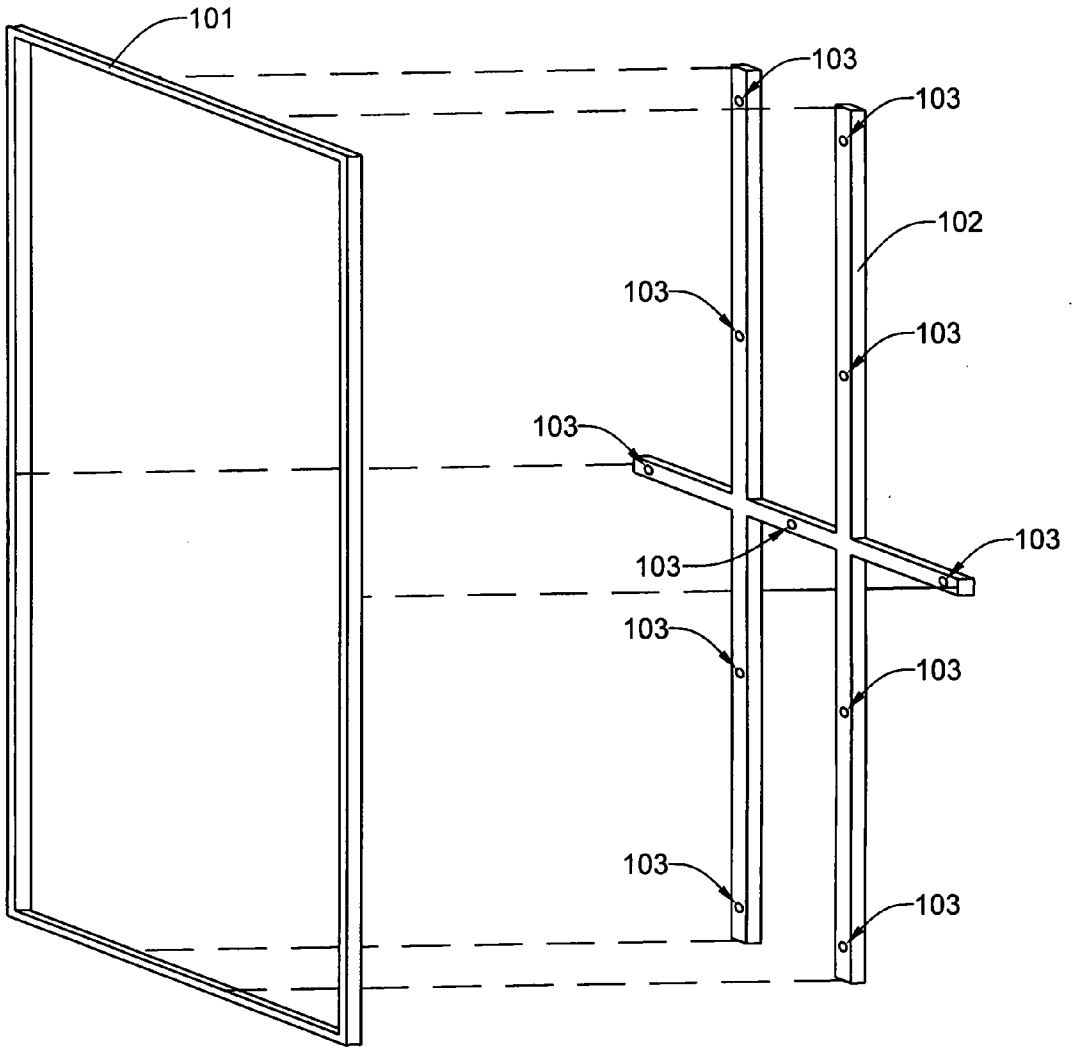
FIG. 1 is an exploded isometric view of the internal grid for a double pane window having multiple permanent neodymium-iron-boron (NIB) magnets passing through the grid elements, and a perimetric seal for the double-pane window.

The invention will now be described with reference to the attached drawing FIGS. 1 to 5. It should be understood that the drawing figures are not necessarily drawn to scale and are meant to be merely illustrative of the invention.

Referring now to FIG. 1, a double-pane perimetric window seal 101 is shown with an internal grid 102. The internal grid 102 can be fabricated from wood, an engineered wood product (essentially compressed sawdust held together in a matrix containing a glue or other bonding agent, or a non-ferrous material such as aluminum. The internal grid 102 is provided with apertures in which are positioned neodymium-iron-boron (NIB) permanent magnets 103. The NIB permanent magnets 103 extend from one side of the grid to the other. Although the NIB magnets 103 can be adhesively or frictionally secured within the apertures, the panes of glass will effectively retain them in place once the internal grid is secured between the panes of glass 5 and 6 and the assembly consisting of panes 5 and 6, internal grid 3 and the NIB magnets is mounted within the window frame. The NIB magnets are more or less evenly spaced throughout the internal grid structure. It is preferred that a magnet be adjacent the end of each grid member. It should also be mentioned that a very strong magnetic field extends from both ends of each NIB magnet. The magnetic field at the location of each magnet is more than sufficient to permeate the glass panes of a typical residential window and secure a ferrous object on the side of each glass pane which faces away from the magnet.

Figure 2:
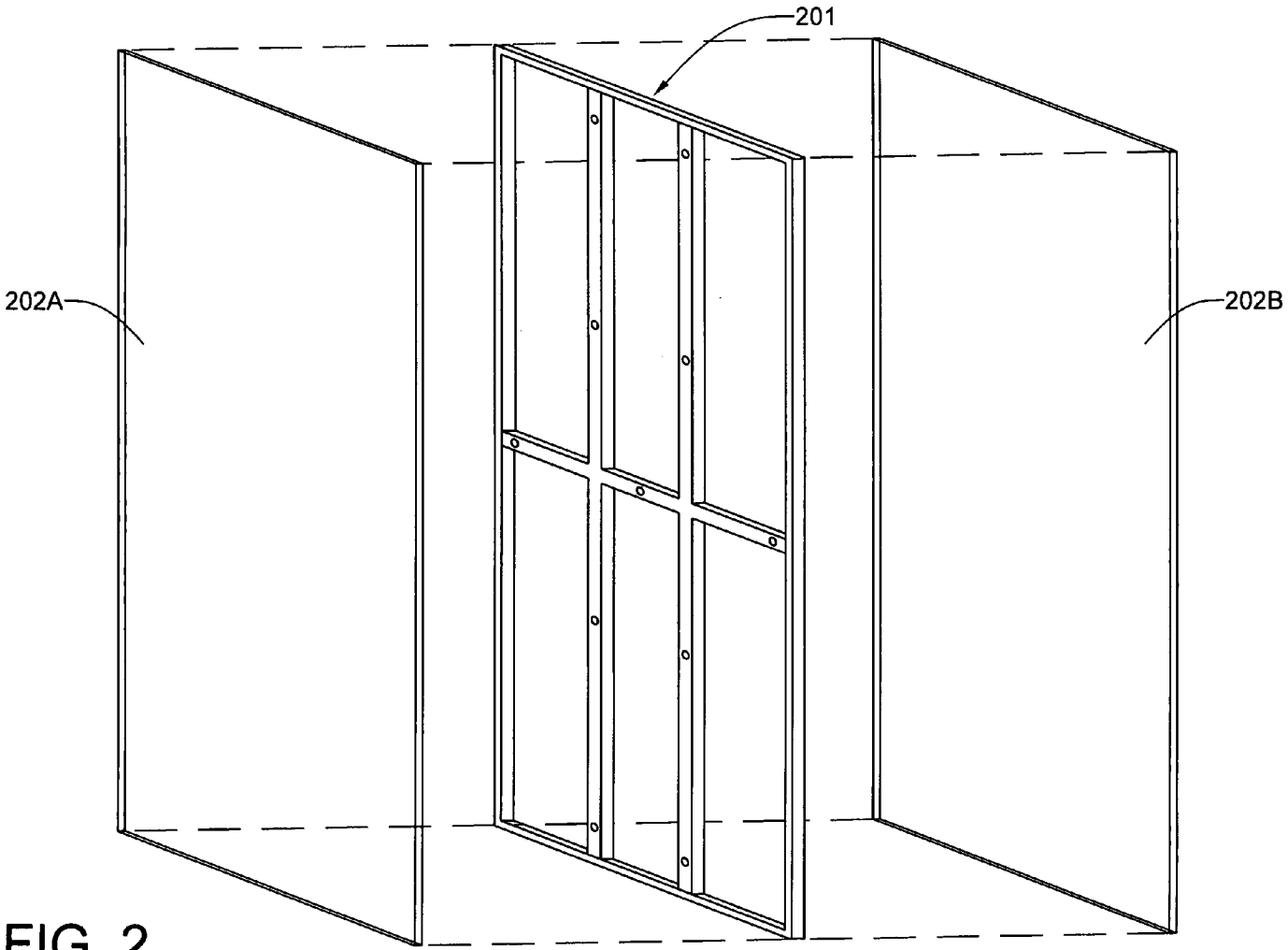
FIG. 2 is an exploded isometric view of the assembled internal grid and perimetric seal of FIG. 1, in combination with the individual window panes.

Referring now to FIG. 2, the internal grid 102 and perimetric seal 101 of FIG. 1 have formed a grid/seal assembly 201, and are ready to receive glass panes 202A and 202B on opposite sides thereof. The sides of the perimetric seal 101 are adhesively bonded to the panes with a durable adhesive such as polyurethane adhesive.

Figure 3:
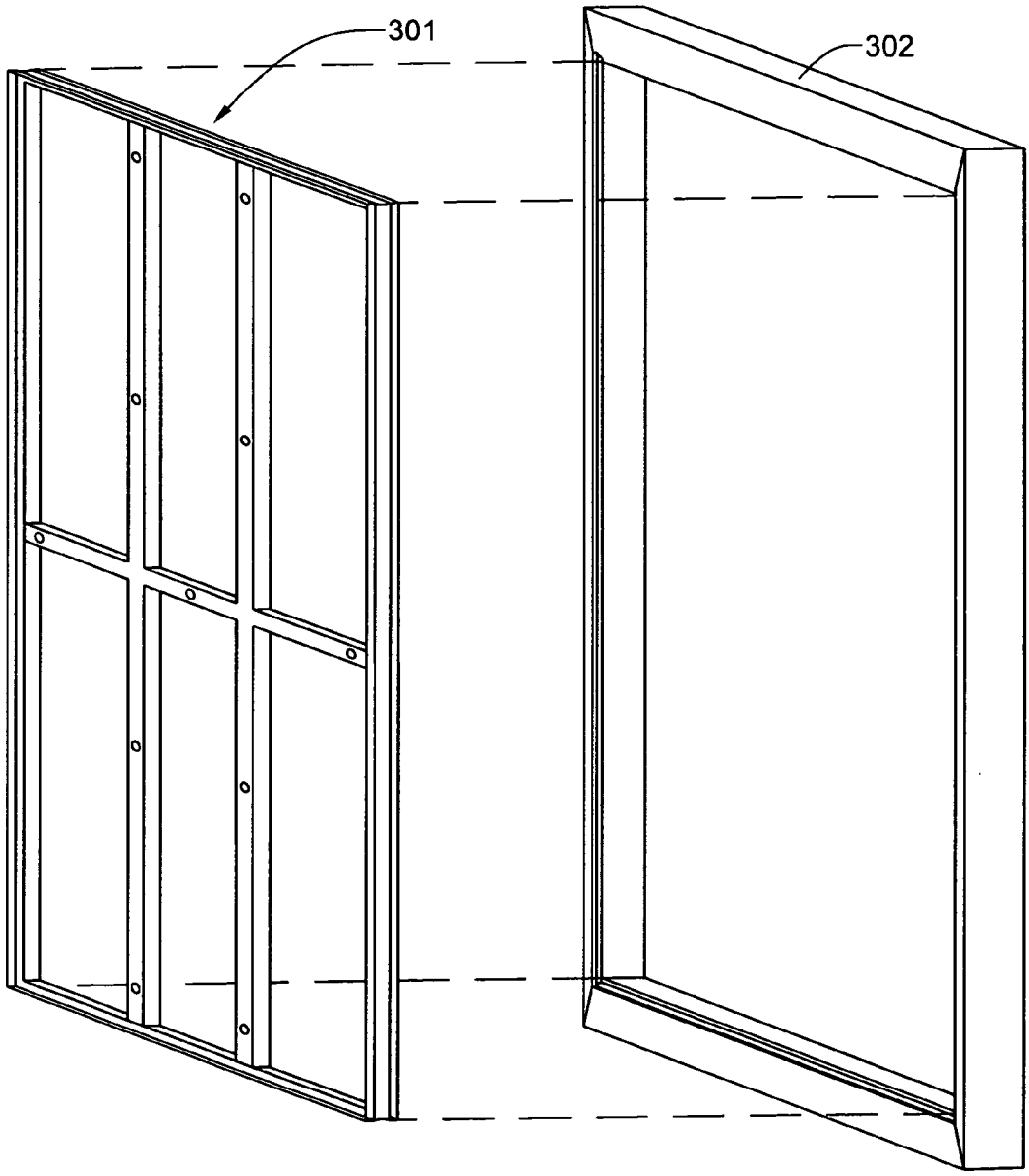
FIG. 3 is an exploded isometric view of the assembled double-pane window assembly and the window frame prior to assembly.

Referring now to FIG. 3 the grid/seal assembly 201 and the glass panes 202A and 202B have formed a window pane assembly 301. It should be understood that each of NIB permanent magnets abuts against both panes of the double-pane window assembly 301. It is shown ready for installation within a window frame 302.

Figure 4:
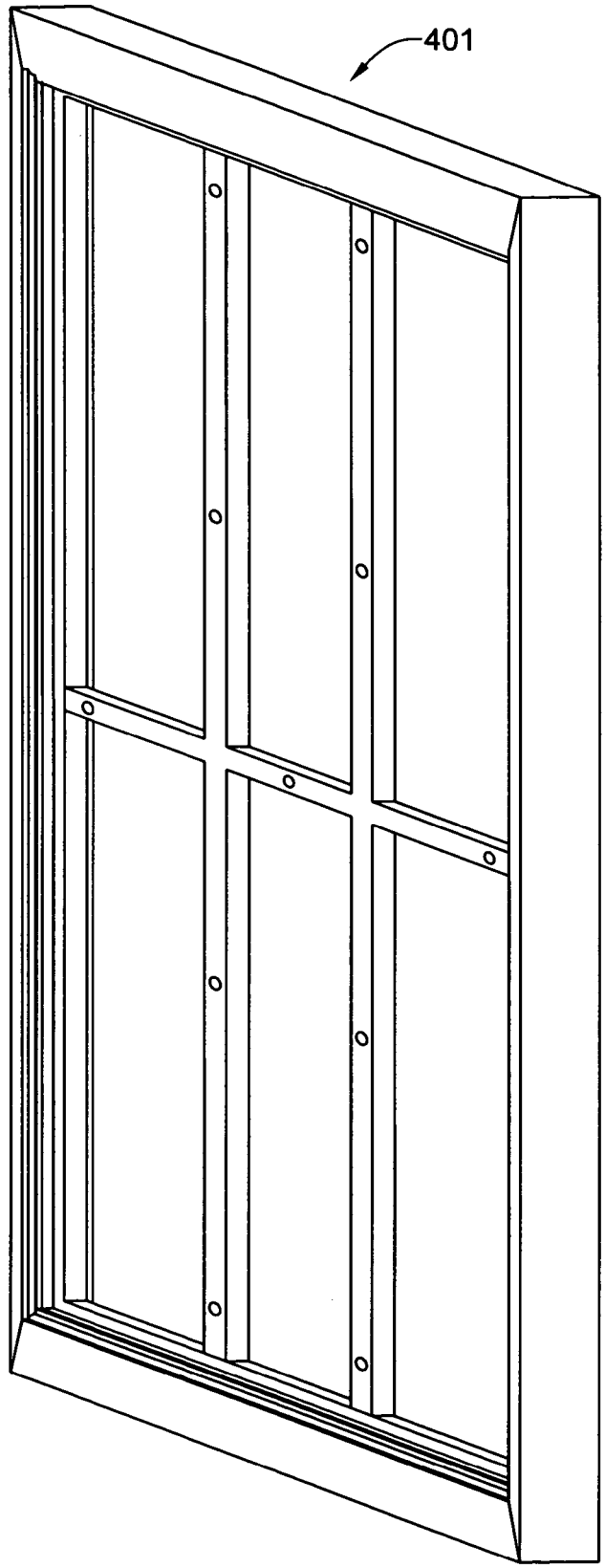
FIG. 4 is an assembled isometric view of the double-pane insulated window assembly installed in the window frame.

Referring now to FIG. 4, the window pane assembly 301 and the window frame 302 have formed a complete window assembly 401.

Figure 5:
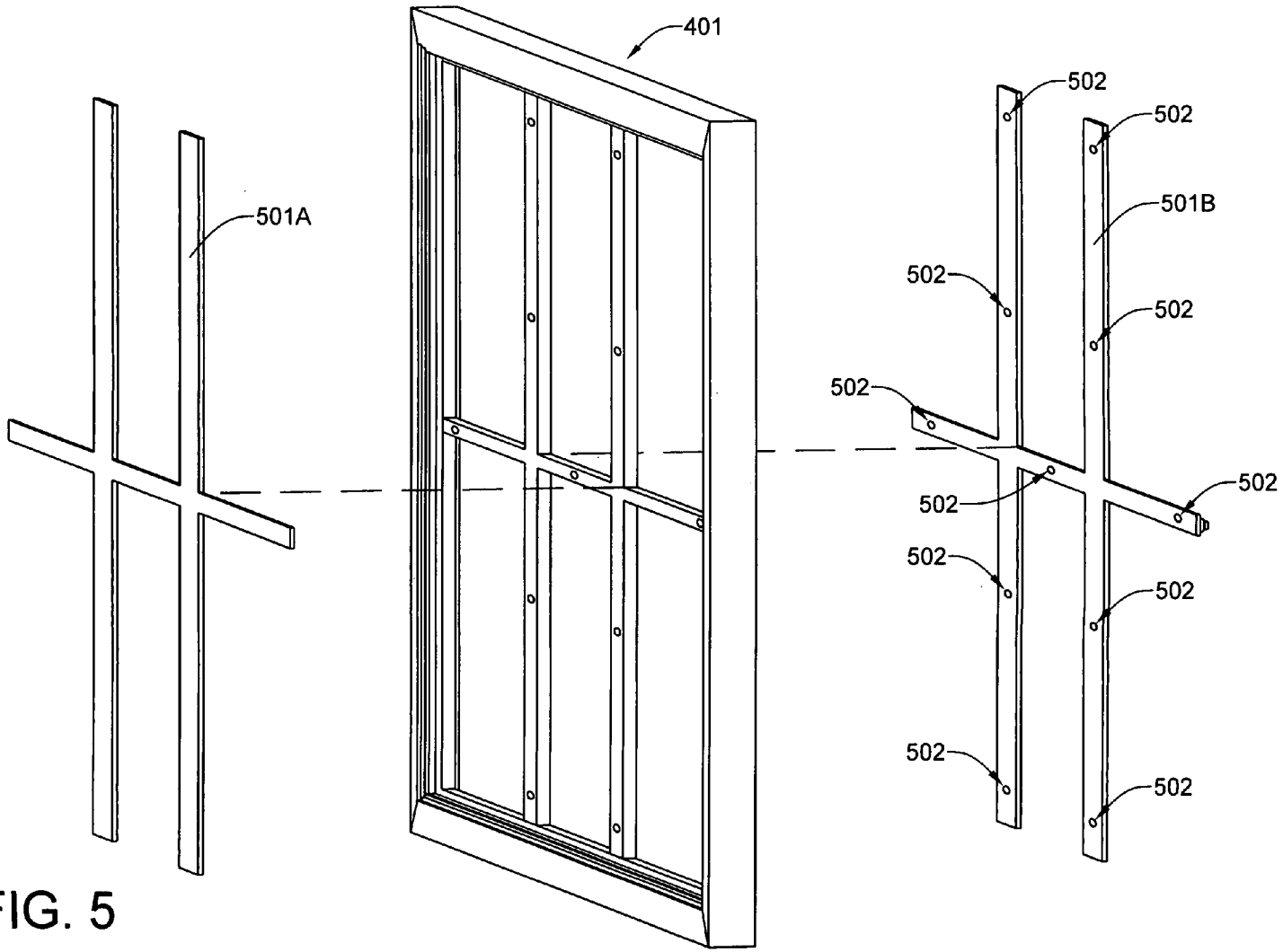
FIG. 5 is an exploded view of the mutton/mullion assemblies having iron inserts embedded therein prior to their installation on the double-pane insulated window and frame assembly of FIG. 4.

Referring now to FIG. 5, a pair of mutton/mullion assemblies 501A and 501B having iron inserts 502 embedded therein are shown ready for installation on the opposing panes 202A and 202B of the complete window assembly 401 of FIG. 4. An inner mutton/mullion assembly will not be exposed to the harsh outside environment and, thus, can be made of wood, plastic, or composite (i.e., structural fiber-filed) material. Inserts made of a ferromagnetic metal, such as steel or iron, are threaded, bonded, or both threaded and bonded in apertures formed in the wood, plastic or composite material on the back side of the mutton/mullion assembly that will face the window pane 202A or 202B. An outer mutton/mullion assembly (i.e., one that is used on the exterior of building is preferably made of extruded aluminum for durability. The steel or iron inserts, which are preferably externally threaded, are anchored in internally-threaded apertures formed in the back side of the mutton/mullion assembly that will face the window pane 202A or 202B. Although threaded securement of the ferrous inserts to the external grids used on the exterior of a building is generally considered the preferred method of attachment, adhesive bonding of the ferrous inserts will also suffice. The magnetic attachment means, which does not degrade over time, permits the outer grids to be easily and readily removed from the opposed window panes. Thus, both the mutton/mullion assemblies 501A and 501B and the single light pane beneath each of them can be easily cleaned with minimum labor. Likewise, the mutton/mullion assemblies 501A and 501B can be prepared and refinished or spray painted in a single operation.

Although only a single embodiment of the invention has been heretofore disclosed and described, it will be obvious to those having ordinary skill in the art that changes and modifications may be made thereto without departing from the scope and the spirit of the invention as hereinafter claimed.

What is claimed is:

1. A simulated authentic divided-light window comprising:

an internal grid structure sandwiched between the panes of a double-pane sealed window, said internal grid structure having a plurality of neodymium-iron-boron permanent magnets, each of which extends from one side of the internal grid to the other side thereof and abuts against both panes; and internal and external mutton/mullion assemblies, each of which has embedded therein multiple ferromagnetic metal inserts which align with the neodymium-iron-boron magnets of the internal grid, each of said mutton/mullion assemblies magnetically adhering to one of the panes of the window and providing for their easy removal for cleaning of the panes and maintenance of the window frame and mutton/mullion assemblies.

2. A simulated authentic divided-light window comprising:

an internal grid structure sandwiched between a pair of parallel glass panes which are joined at the peripheries thereof with an airtight seal to form a sealed double-pane window assembly, said internal grid structure having a plurality of neodymium-iron-boron permanent magnets, each of which extends from one side of the internal grid to the other side thereof and abuts against an inner surface of each pane; and internal and external mutton/mullion assemblies, each of which has embedded therein multiple ferromagnetic metal inserts which align with the neodymium-iron-boron magnets of the internal grid, each of said mutton/mullion assemblies magnetically adhering to one of the panes of the window and providing for their easy removal for cleaning of the panes and maintenance of the window frame and mutton/mullion assemblies.

* * * * *